US006577054B1

(12) United States Patent
Kim et al.

(10) Patent No.: US 6,577,054 B1
(45) Date of Patent: Jun. 10, 2003

(54) ELECTRON GUN FOR CRT WITH HELICAL MULTI-LENS ELECTRODE ASSEMBLY

(75) Inventors: Sang-mook Kim, Suwon (KR); Sang-kyun Kim, Incheon (KR); Duk-sung Park, Suwon (KR); Bong-wook Jung, Seoul (KR); Yeong-guon Won, Suwon (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 161 days.

(21) Appl. No.: 09/617,092

(22) Filed: Jul. 14, 2000

(30) Foreign Application Priority Data

Aug. 23, 1999 (KR) ..... 99-34920

(51) Int. Cl.[7] ..... H01J 29/46
(52) U.S. Cl. ..... 313/450; 313/417; 313/446
(58) Field of Search ..... 313/450, 417, 313/446, 447, 448, 449, 451

(56) References Cited

U.S. PATENT DOCUMENTS 4,143,298 A * 3/1979 Bing et al. ..... 315/3
4,349,767 A * 9/1982 Muramoto et al. ..... 313/449
4,516,051 A * 5/1985 Hooft van Huijsduijnen ..... 313/446
4,687,964 A * 8/1987 Ebihara et al. ..... 313/237
4,827,184 A 5/1989 Spanjer et al. ..... 313/450
4,961,023 A 10/1990 Vrijssen et al. ..... 313/456
5,521,462 A * 5/1996 Muchi et al. ..... 313/409
6,133,683 A * 10/2000 Enomoto et al. ..... 313/414

* cited by examiner

*Primary Examiner*—Vip Patel
*Assistant Examiner*—Kevin Quarterman
(74) *Attorney, Agent, or Firm*—Lowe Hauptman Gilman & Berner, LLP

(57) ABSTRACT

An electron gun for cathode ray tubes (CRTs) with a helical multi-lens electrode assembly which is formed by coupling auxiliary electrodes to both ends of a helical resistive coil. The auxiliary electrodes have claws to be embedded in bead glasses, so that the helical resistive coil is mechanically supported in the electron gun. As a voltage is applied to the helical resistive coil through the auxiliary electrodes, multiple electron lenses are created due to voltage drops in each pitch of the helical resistive coil.

10 Claims, 4 Drawing Sheets

ELECTRON GUN FOR CRT WITH HELICAL MULTI-LENS ELECTRODE ASSEMBLY

BACKGROUND OF THE INVENTION

1. Field of the Invention

The present invention relates to an electron gun for cathode ray tubes (CRTs), and more particularly, to an electron gun for CRTs with a helical multi-lens electrode assembly.

2. Description of the Related Art

Resolution of a CRT depends mainly on the diameter of electron beams to landing on the screen, which have been focused and accelerated by an electron lens of the electron gun. The diameter of electron beams decreases with a decrease in spherical aberration of the electron lens, and such a small spherical aberration is achieved by increasing the aperture size of electrodes of the electron gun. An electron gun having larger-aperture electrodes is desired for better resolution. However, there is a limit to increasing the aperture size because the neck, in which the electron gun is installed, correspondingly should increase, which requires greater deflection power and increased deflection distortion as a result. Also, the bead glass that supports multiple electrodes of an electron gun in place limits the aperture size.

In order to overcome this limitation, a multi-stage lens technique, in which a plurality of electron lenses are arranged for a reduction of spherical aberration, was proposed. However, this technique consumes many electrodes and results in a complicated electron gun, thereby increasing the manufacturing cost with a low product reliability. Also, there is a problem in that the length of electron gun limits the number of electrodes to be accommodated therein.

The alternative to the multi-stage lens is a helical multi-lens electrode assembly. FIG. 1 shows a cross section of a helical multi-lens electrode assembly 10. Such as helical structure of the electrode assembly 10 is obtained by coating a high-resistive layer 14 on the inner surface of a glass tube 12 in a helical pattern. Once different voltages are applied to the two ends of the electrode assembly 10, voltage drops in each pitch of the helix occurs, and electron lenses, as many as the pitches of helix, are formed due to voltage potential differences between adjacent pitches. The helical type lens can offer much smaller spherical aberration than prior large-aperture electron guns the aperture of which is recessed. Reportedly, it is not possible to implement the equivalent spherical aberration with the larger-aperture electron gun since the aperture size is beyond the aperture of the neck (refer to Society of Information Display, 1998, digest, pp. 429). Such a helical multi-lens electrode assembly is made by first forming a high-resistive layer on the inner surface of a glass tube and mechanically removing some of the coating in a helix pattern.

However, such a mechanical formation of helix is a challenging task since it requires a high precision, resulting in a low productivity. Moreover, unless the coating density and thickness, and the section of helix are maintained uniformly within one assembly, or from one assembly to another, its variation in terms of quality becomes too large to be commercially viable. A multi-lens electrode assembly made this way may accumulate charges on the uncoated glass surface and negatively affect the internal pressure in the tube because of possible presence of resistive particles after mechanical grinding away of the resistive coating in a helix pattern. Further in order to fixedly arrange such a conventional helical lens type electrode assembly in an electron gun, metal projections or claws as commonly used in the art should be attached on the electrode assembly to be embedded in the bead glass. This requires a highly complex metal-glass bonding technology.

At least for the reasons mentioned above no CRT employing helix-patterned multi-lens electrode assembly has been commercialized.

SUMMARY OF THE INVENTION

It is an objective of the present invention to provide an electron gun for cathode ray tubes (CRTs) with a helical multi-lens electrode assembly, which is easily made and yet reduces spherical aberration substantially.

To solve the above problems, it is an objective of the present invention to provided an electron gun for a cathode ray tube with a helical multi-lens electrode assembly including a helical resistive coil and two auxiliary electrodes. Each of the auxiliary electrodes has claws to be embedded in bead glasses to hold the helical resistive coil in the electron gun. When voltages are applied to the helical resistive coil through the auxiliary electrodes coupled to both ends of the coil, voltage drops occur in each pitch of the helical resistive coil, creating a plurality of electron lenses.

Preferably, each of the auxiliary electrodes has a stepped hollow cylindrical extension at one end thereof, and the auxiliary electrodes are coupled to the helical resistive coil by fitting the stepped hollow cylindrical extensions into the both ends of the helical resistive coil. Preferably, each stepped hollow cylindrical extension of the auxiliary electrodes has helical grooves, the helical grooves being fitted with the inner diameter and pitches of the helical resistive coil, and the stepped hollow cylindrical extensions are screw coupled to the both ends of the helical resistive coil. If there is a difficult in integrally forming the stepped cylindrical extension in auxiliary electrodes, the stepped hollow cylindrical extensions may be separated formed and then welded to the auxiliary electrodes.

Preferably, a projection is formed in the middle of the helical resistive coil for electrical connection to a metal lead such that a focus voltage is applied to the middle of the helical resistive coil. Alternatively, a metal lead may be formed at the middle of the helical resistive coil such that a focus voltage is applied to the middle of the helical resistive coil.

BRIEF DESCRIPTION OF THE DRAWINGS

The above objective and advantages of the present invention will become more apparent by describing in detail preferred embodiments thereof with reference to the attached drawings in which.

DETAILED DESCRIPTION OF THE INVENTION

Figure 1:
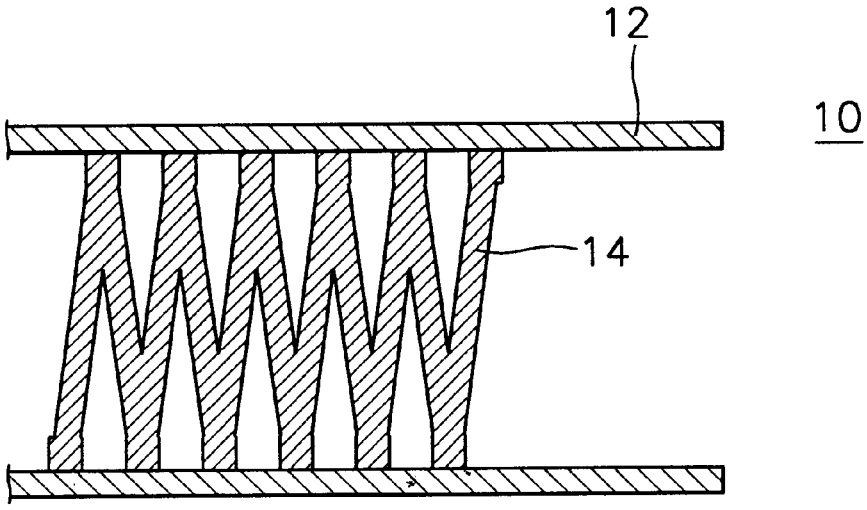
FIG. 1 (PRIOR ART)
FIG. 1 is a sectional view of a conventional helical multi-lens electrode assembly.
Figure 2:
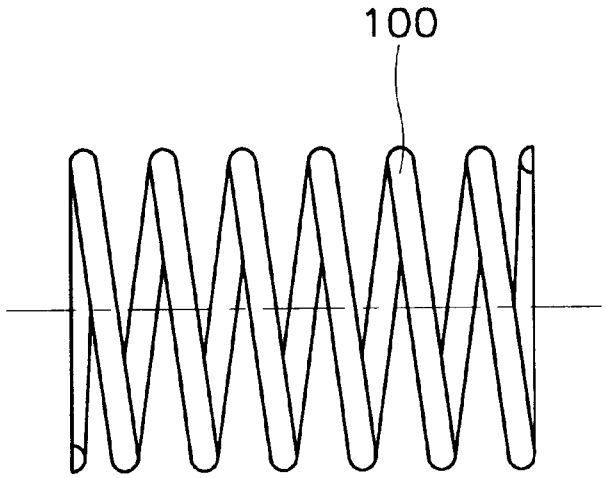
FIG. 2 is a perspective view of a multi-lens in the form of a helical resistive coil according to the present invention.

As shown in FIG. 2, which shows a multi-lens in the form of a helical resistive coil according to the present invention, the helical resistive coil 100 can be formed by forming a wire of resistive material into the helical coil or may be formed by sintering. Auxiliary electrodes are coupled to both ends of the helical resistive coil 100 to provide for mechanical support as well as electrical terminals.

Figure 3A:
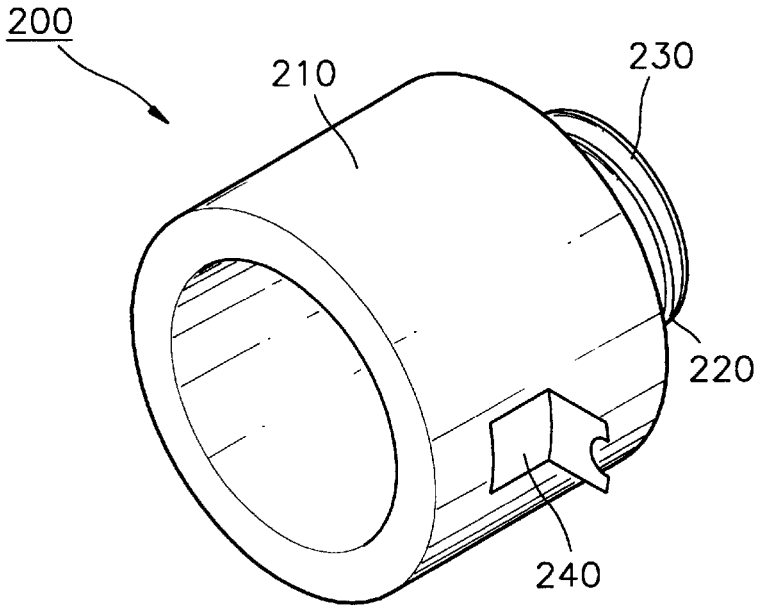
FIGS. 3A and 3B are a perspective view and a sectional view of an auxiliary electrode according to the present invention, respectively.
Figure 3B:
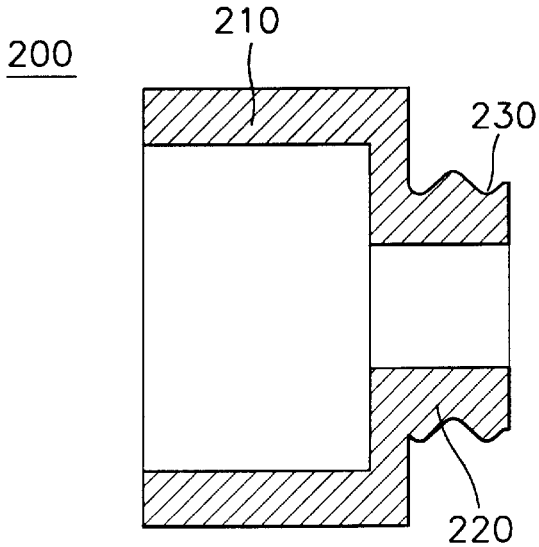

FIGS. 3A and 3B are a perspective view and a sectional view of an auxiliary electrode according to the present invention, respectively. The auxiliary electrode 200 includes a hollow main cylinder 210 and a smaller-diameter hollow cylindrical extension 220 formed at one end of the hollow main cylinder 210. On the outside of the hollow main cylinder 210 are formed clams 240 for insertion into bead glass. The hollow cylindrical extension 220, which is stepped form the hollow main cylinder 210, may have screw-like grooves 230, which fit with the inner diameter and pitches of the helical resistive coil 100.

Figure 4:
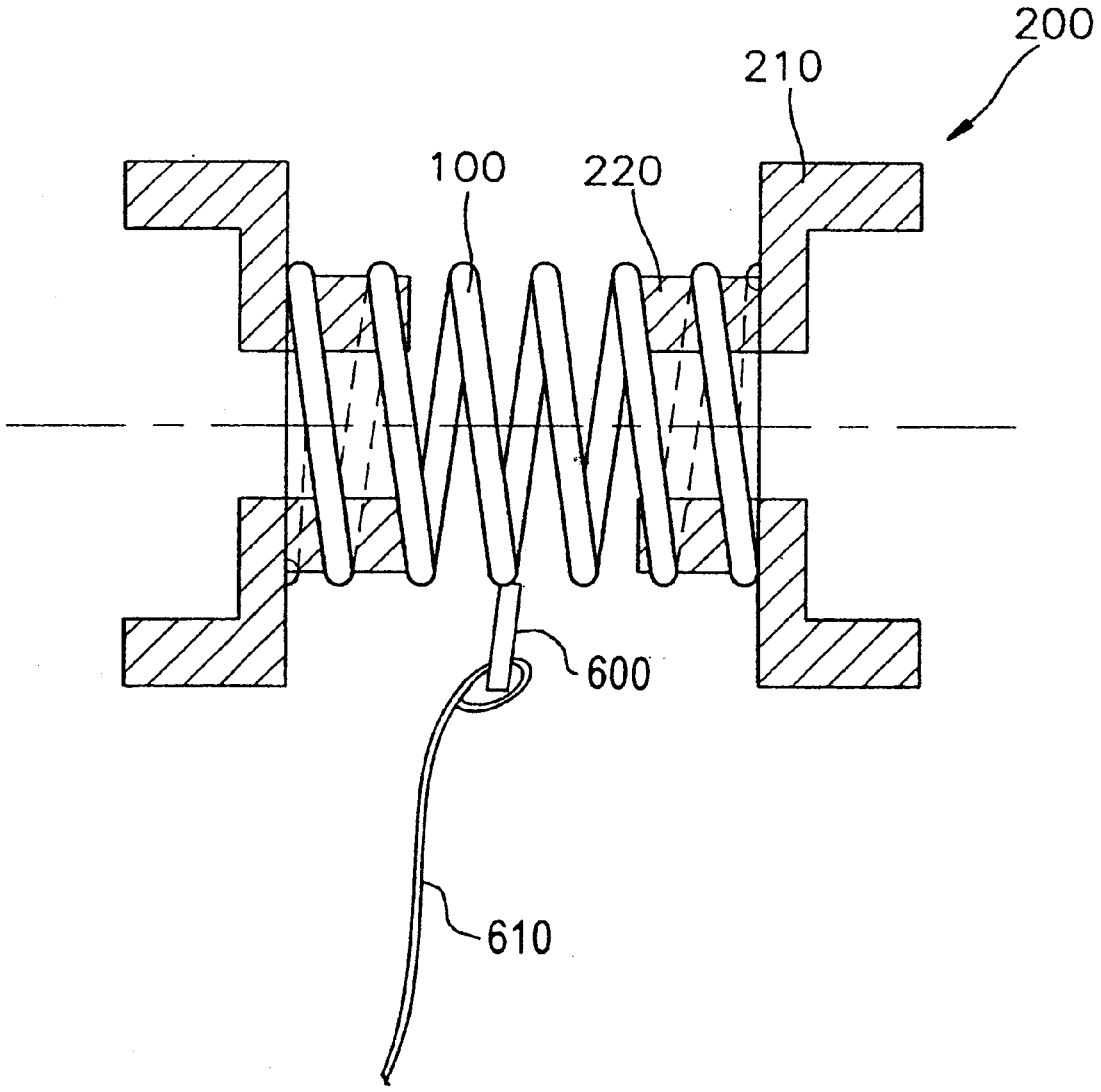
FIG. 4 is a sectional view illustrating coupling of the auxiliary electrodes into the ends of the helical resistive coil.

FIG. 4 shows a coupled state of the helical resistive coil and the auxiliary electrodes according to the present invention. The hollow cylindrical extension 220 of the auxiliary electrode 200 is inserted into one end of the helical resistive coil 100. Since the auxiliary electrode 200 is formed of metal, the auxiliary electrode 200 can be easily fitted into the helical resistive coil 100 due to certain resiliency of the metal. If the hollow cylindrical extension 220 further has screw-like grooves 230, the auxiliary electrode 200 can be coupled to the helical resistive coil 100 by screw coupling, which allows for a more rigid support structure. The claws 240 of the auxiliary electrode 200 are embedded in the bead glass to be mounted into an electron gun. The hollow cylindrical extension 220 may be formed either integrally with the main hollow cylinder 200 or be separately formed.

Figure 5:
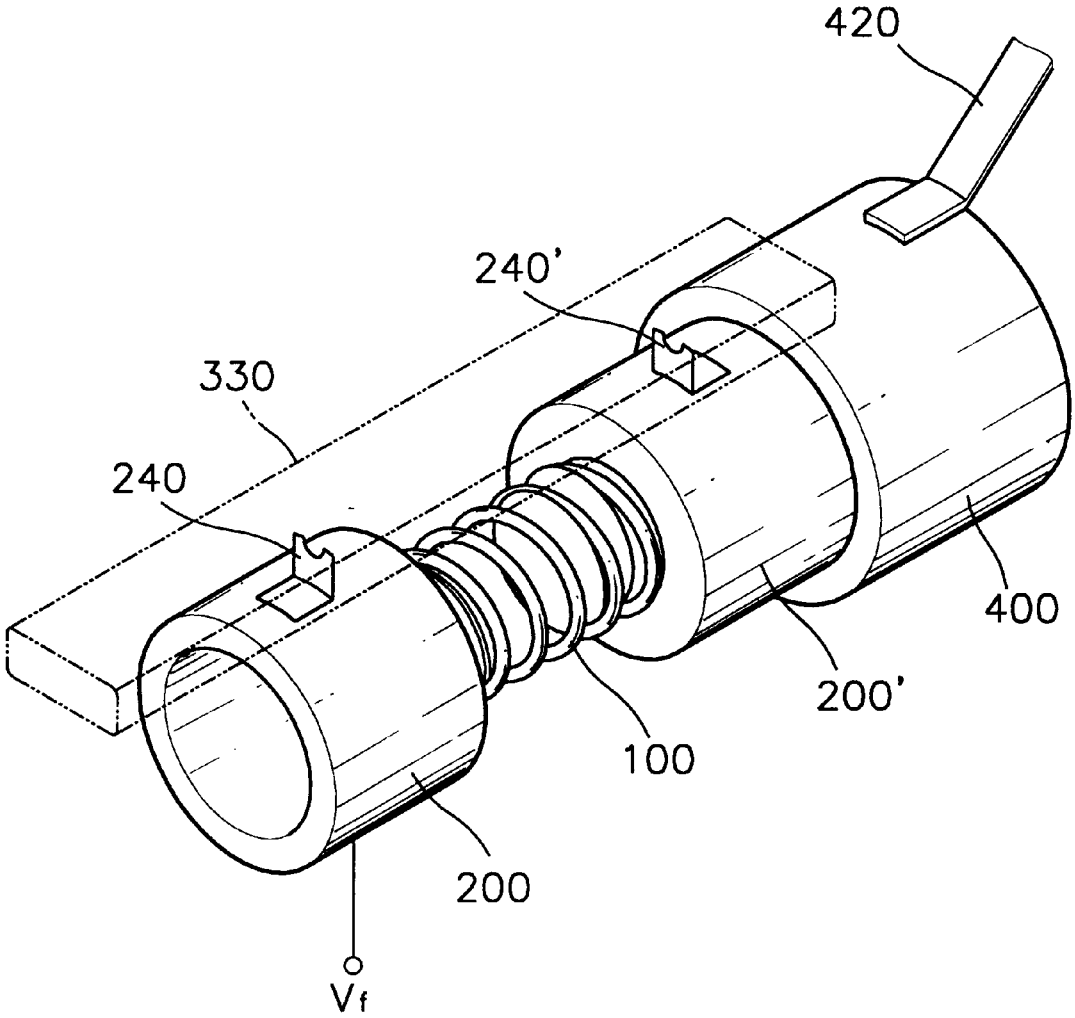
FIG. 5 is a perspective view illustrating further coupling of the electrode assembly of FIG. 4 with an electron gun.

FIG. 5 shows the inventive helical multi-lens electrode assembly coupled with an electrode gun. Two auxiliary electrode 200 and 200' are inserted into both ends of the helical resistive coil 100. The auxiliary electrode 200' is connected to a shield cup 400 with a spacer 420 contacting the conductive coating on the inner surface of a CRT funnel. A pair of bead glasses 330, only one of which is shown with the dot-dash line in FIG. 5, are mounted on the auxiliary electrodes 200 and 200'. Claws 240 and 240' are embedded in the bead glass 330.

A focus voltage is applied to the auxiliary electrode 200 and a final accelerating voltage is applied to the other auxiliary electrode 200'. Voltage drops occur in each pitch of the helical resistive coil 100, creating a plurality of thin electron lenses, the number of which is equal to the number of pitches in the helical resistive coil 100.

As shown in FIG. 4, a projection 600 may be formed in the middle of the helical resistive coil 100 for electrical connection to an external metal lead 610 so that a focus voltage can be applied thereto. Alternatively, a metal lead may be formed at the middle of the helical resistive coil 100, which enables application of a focus voltage to the middle of the same. For example, this structure is advantageous in electrical connection of unipotential focus (UPF) type electron gun.

The helical resistive coil according to the present invention can be easily manufactured by wire formation or by sintering. Also, installation of the helical resistive coil into an electron gun can be smoothly carried out with auxiliary electrodes. Thus, the present invention enables practical use of the electron gun employing a helical multi-lens electrode assembly in a CRT. In addition, the electron gun adopting the helical multi-lens electrode assembly simplifies the overall manufacturing process with an improved productivity and reliability.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electron gun for a cathode ray tube with a helical multi-lens electrode assembly, comprising:

a helical resistive coil; and two auxiliary electrodes, each of which is formed of a metal and is coupled to one respective end of the helical resistive coil, each auxiliary electrode having a claw to be embedded in bead glass to hold the helical resistive coil in the electron gun;

wherein voltage drops occur in each pitch of the helical resistive coil, creating a plurality of electron lenses when voltages are applied to the auxiliary electrodes; and wherein each of the auxiliary electrodes has stepped hollow cylindrical extension at one end thereof, and the stepped hollow cylindrical extensions of each of the respective auxiliary electrodes are located within respective ends of the helical resistive coil.

2. The electron gun of claim 1, wherein each stepped hollow cylindrical extension of each of the auxiliary electrodes has helical grooves, the helical grooves being fitted with the inner diameter and pitches of the helical resistive coil, and wherein the stepped hollow cylindrical extension of each of the auxiliary electrodes is screw coupled to the respective end of the helical resistive coil.

3. The electron gun of claim 1, wherein the respective stepped hollow cylindrical extensions of the auxiliary electrodes are welded to the respective auxiliary electrodes.

4. The electron gun of claim 2, wherein the respective stepped hollow cylindrical extensions of the auxiliary electrodes are welded to the respective auxiliary electrodes.

5. The electron gun of claim 1, wherein a projection is formed in the middle of the helical resistive coil for electrical connection to a metal lead such that a focus voltage may be applied to the middle of the helical resistive coil.

6. The electron gun of claim 2, wherein a projection is formed in the middle of the helical resistive coil for electrical connection to a metal lead such that a focus voltage may be applied to the middle of the helical resistive coil.

7. The electron gun of claim 3, wherein a projection is formed in the middle of the helical resistive coil for electrical connection to a metal lead such that a focus voltage may be applied to the middle of the helical resistive coil.

8. The electron gun of claim 1, wherein a metal lead is formed at the middle of the helical resistive coil such that a focus voltage may be applied to the middle of the helical resistive coil.

9. The electron gun of claim 2, wherein a metal lead is formed at the middle of the helical resistive coil such that a focus voltage may be applied to the middle of the helical resistive coil.

10. The electron gun of claim 3, wherein a metal lead is formed at the middle of the helical resistive coil such that a focus voltage may be applied to the middle of the helical resistive coil.

* * * * *